US005577643A

United States Patent [19]

Stolz

[11] Patent Number: 5,577,643

[45] Date of Patent: Nov. 26, 1996

[54] CLOSURE AND CONTAINER

[75] Inventor: Bernd Stolz, Neunkirchen, Germany

[73] Assignee: Heinrich Stolz GmbH & Co. KG, Germany

[21] Appl. No.: 340,589

[22] Filed: Nov. 16, 1994

[30] Foreign Application Priority Data

May 19, 1994 [DE] Germany ..... 44 17 492.6

[51] Int. Cl.[6] ..... B65D 25/44

[52] U.S. Cl. ..... 222/529; 222/530; 222/541.9; 222/569

[58] Field of Search ..... 222/529, 530, 222/541.6, 541.9, 569

[56] References Cited

U.S. PATENT DOCUMENTS

| | | | |
|---|---|---|---|
| 2,981,449 | 4/1961 | Perkins | 222/569 X |
| 3,204,827 | 9/1965 | Krautkramer | 222/530 X |
| 3,834,597 | 9/1974 | Guala | 222/541.9 X |
| 4,669,640 | 6/1987 | Ando et al. | 222/569 X |
| 5,031,804 | 7/1991 | Conrad | 222/569 X |

FOREIGN PATENT DOCUMENTS

| | | | |
|---|---|---|---|
| 0132904 | 2/1985 | European Pat. Off. . | |
| 32555 | 11/1962 | Finland | 222/569 |
| 2578819 | 9/1986 | France | 222/529 |
| 1924824 | 3/1978 | Germany | 222/529 |
| 8002546 | 11/1980 | WIPO | 222/529 |

*Primary Examiner*—Kevin P. Shaver
*Attorney, Agent, or Firm*—Speckman, Pauley & Fejer

[57] ABSTRACT

A closure for a container with a lower closure element and a closure cap which can be placed on the lower closure element. The lower closure element is connected to the opening of a container by a base element having a contact flange which rests on the interior of the container against a contact face formed in the area of the opening of the container. At least one locking projection is disposed on the base element in the axial direction of the container closure and at a distance from the contact flange. The locking projection extends over the rim of the opening so that the lower container element is held axially immovable in the container.

10 Claims, 1 Drawing Sheet

CLOSURE AND CONTAINER

BACKGROUND OF THE INVENTION

1. Field of the Invention

This invention relates to a closure for a container with a lower closure element and a closure cap which can be placed on the lower closure element. The lower closure element is connected to the opening of a container by a base element having a contact flange which rests on the interior of the container against a contact face formed in the area of the opening of the container.

2. Description of Prior Art

Generally, closures of the type described hereinabove are employed for containers which are filled with a substance under pressure. The contact flange is pressed against the contact face because of the pressure difference with the atmosphere surrounding the container, so that the container closure cannot be pushed out of the opening. A container closure of this type is taught by European Patent Publication EP 0 132 904 A2.

SUMMARY OF THE INVENTION

It is an object of this invention to provide a container closure as set forth hereinabove which can be simply installed with little effort in the container.

This object is attained by a closure in accordance with one embodiment of this invention comprising at least one locking projection disposed on the base element in the axial direction of the container closure and at a distance from the contact flange, which projection extends over the rim of the opening, so that the lower container element is held axially immovable in the container.

For installation in the container, the container closure is passed from the inside of the container through the opening until the locking projections are deflected at the rim surrounding the opening and snap in behind it from the outside of the container. In this installed position, the rim of the opening is enclosed between the locking projection and the contact flange. As a result, it is no longer possible to displace the container closure axially in respect to the opening. In order to achieve radial fixing, the locking projection and the contact flange border on a groove, wherein the dimensions of the bottom of the groove correspond to or are slightly smaller than the outer dimensions of the opening.

In accordance with one preferred embodiment of this invention, the contact face of the container is folded toward the outside in relation to the inner wall and forms a circular receptacle. The contact flange of the base element is inserted into this receptacle in such a way that it terminates flush with the inner wall of the container or is recessed in respect to it. In this way, the contact flange does not project into the interior of the container. The material in the container then can be completely removed.

A solid connection between the container and the container closure is provided in accordance with one embodiment of this invention where the locking projection is formed on the base element as a circumferential collar and has a deflection slope slowly rising in the direction toward the closure cap and makes a transition into a steep locking flank which rests around the rim of the opening on the outside of the container.

Unintentional pushing of the container closure into the container is assuredly prevented because the steep locking flank is supported circumferentially on the outside of the container. Furthermore, the circumferential locking projection prevents severing of the locked connection even if forces are introduced obliquely or in an off-centered manner into the container closure.

In accordance with one embodiment of this invention, at least the locking projection and the contact flange of the base element are made of a resilient plastic material, so that the rim of the opening is maintained braced and without play between the locking projection and the contact flange and the contact flange sealingly rests against the contact face of the container. As a result, a simultaneous seal without the aid of additional sealing elements is provided when the container closure is firmly braced on the container.

In accordance with another embodiment of this invention, the exterior dimensions of the base element are the same or less than the dimensions of the opening. The base element is provided with a chamfer by which the base element can be threaded from the inside into the opening of the container. The exterior size of the closure cap is selected to be smaller than the size of the opening. In this way, the closure part and the closure cap can be preassembled as a structural unit which can be connected to the container in one assembly step. The base element of the lower closure element is provided with a chamfer to make assembly easier.

For simple removal of the material from the container, an elastic, axially extractable bellows is connected to the base element of the lower closure element which makes a transition into a pouring spout having an exterior thread on which the closure cap is screwed. A sealing plate with a handle is inserted into the pouring spout. The bellows can be extracted out of the container closure and the closure cap can subsequently be removed. As a result, the handle of the sealing plate is accessible so that it can be removed from the pouring spout. The material can then be removed from the container through the pouring opening formed by the pouring spout.

BRIEF DESCRIPTION OF THE DRAWINGS

These and other features and objects of this invention will be better understood from the following detailed description taken in conjunction with the drawings, wherein.

DESCRIPTION OF PREFERRED EMBODIMENTS

Figure 1:
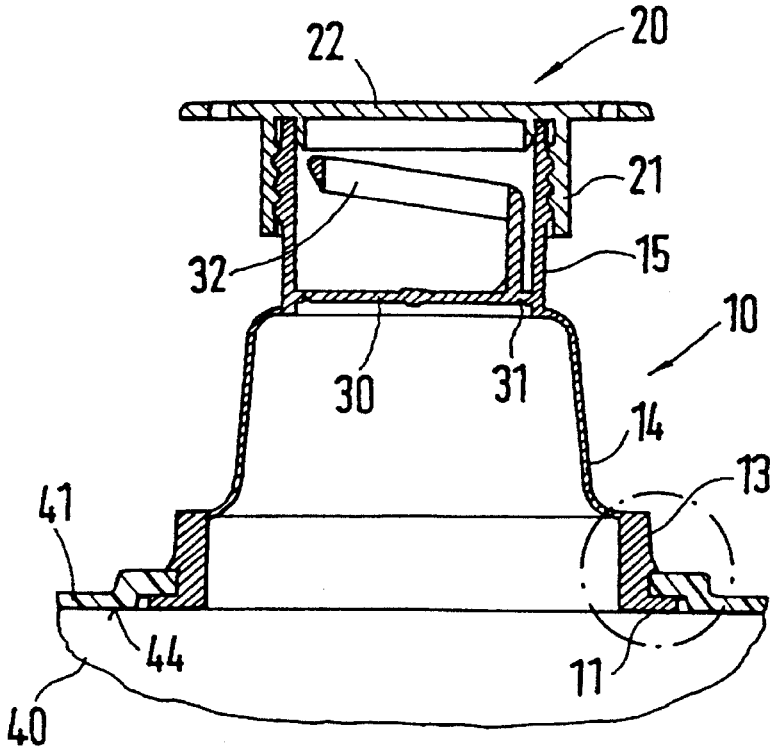
FIG. 1 is a lateral cross-sectional view of a container closure with a closure cap, assembled on a container in accordance with one embodiment of this invention.

A container closure 10 comprising a lower closure element and a closure cap 20 placed on the lower closure element are shown in FIG. 1. The lower closure element has a base element 13, to which an elastically extractable bellows 14 is connected. On its end facing away from the base element 13, the bellows 14 makes a transition into a circular pouring spout 15. The pouring spout comprises an external thread.

A closure cap 20 embodied as a screw cap is screwed on the external thread of the pouring spout 15. The closure cap 20 comprises a lid 22 to which a downwardly extending cylindrical jacket element 21 is connected. The jacket element 21 comprises an interior thread which cooperates with the exterior thread of the pouring spout 15. The pouring opening formed by the pouring spout 15 is closed by a sealing plate 30. The sealing plate 30 is fixed on the interior diameter of the pouring spout 15 by a circumferentially extending predetermined break line 31.

The sealing plate 30 comprises a handle 32 for removing it from the pouring spout 15, which handle 32 essentially is formed by a ring and a stem connected to the ring. The stem is directly connected to the sealing plate 30. To remove the sealing plate 30 from the pouring spout 15, the user inserts a finger into the ring and pulls it out of the pouring spout 15. The sealing plate 30 tears along the predetermined breaking line 31 and, thus, can be removed from the spout 15. A quality assurance is provided in this way which shows whether the container is used for the first time.

Figure 2:
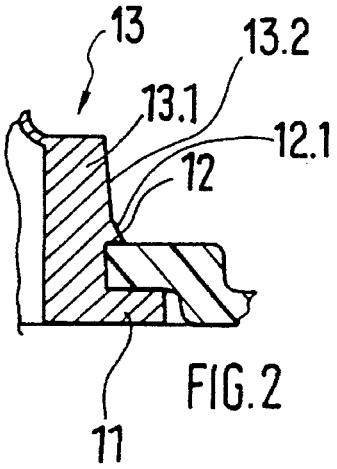
FIG. 2 shows a lateral cross-sectional view of the encircled portion of FIG. 1.

Securing of the container closure 10 on the container 40 is realized in accordance with one preferred embodiment of this invention by a locking connection comprising a contact flange 11 and a circumferential locking projection 12 disposed on the base element 13, as can be more clearly seen from FIG. 2. The base element (13) comprises a chamfer (13.2) by which the base element (13) is threaded form the inside of the container (40) into the opening (43). As shown in FIG. 2, the locking projection 12 is disposed spaced apart from the contact flange 11 in the direction of the container closure. The locking connection is provided with a slowly rising deflection slope 12.1 passing over in a section (13.1) extending in the direction of the closure cap. On its area facing the contact flange 11, the deflection slope 12.1 makes a transition into a steep locking flank.

The container 40, for example a plastic or metal container, forms an opening 43. The opening 43 is enclosed by a rim 42 which is followed on the side facing the container interior by a contact face. The contact face is folded toward the outside in relation to the inner wall 44 formed by the container wall 41.

Figure 3:
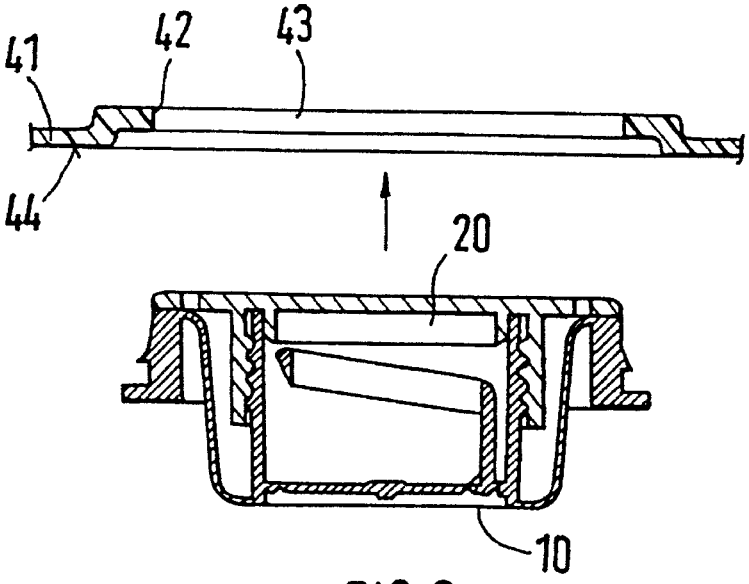
FIG. 3 shows a lateral, exploded cross-sectional view of the container closure and the container shown in FIG. 1.

Assembly of the container closure 10 on the container 40 is shown in detail in FIG. 3. For assembly, the container closure 10, comprising the lower closure part and the closure cap 20, is preassembled as a structural unit. The exterior dimensions of the closure cap 20 and the base element 13 are less than the exterior dimensions of the opening 43. In this way, the container closure 10 can be pushed from the inside of the container 40 through the opening 43. In the process, the rim 42 of the opening 43 slides along the exterior face of the base element 13 until it pushes against the locking projection 12.

Upon continued pushing, the locking projection 12 is deflected radially inward on the rim 42 by virtue of its deflection slope 12.1. Once the locking projection 12 has passed the rim 42, the locking projection 12 snaps outward into its initial position and in this way is placed with its steep locking flank around the opening on the outside of the container. At the same time, the contact flange 11 rests against the contact face of the opening 43.

The lower closure element in accordance with one embodiment of this invention is embodied as a one-piece plastic part. The locking projection 12 and the contact flange 11 in particular are elastically embodied so that the rim 42 of the container 40 is elastically braced. At the same time, the elastic bracing causes the contact flange 11 to be pressed against the contact face of the container 40 so that a sealing effect is achieved between the contact flange 11 and the contact face.

The locking projection 12 and the contact flange 11 prevent the axial movement of the base element 13 in respect to the container 40. The radial locking projection of the lower closure part in respect to the container is prevented in that the dimensions of the groove bottom of the groove formed between the locking projection and the contact flange 11 are adapted to the dimensions of the opening 43.

In accordance with one embodiment of this invention, contact flange 11 is not embodied as a circumferential collar as shown in the drawings, but rather comprises a plurality of segmented pieces. The sealing effect is achieved in accordance with one embodiment by a sealing plate, for example, or in accordance with another embodiment, the sealing effect is achieved between the rim 42 and the opening 43 and the outer shell of the base element 13. It is also not necessary to provide a circumferential locking projection 12. Rather in accordance with one embodiment of this invention, the closure comprises a plurality of locking projections 12 which are disposed offset over the circumference of the base element 13.

I claim:

1. In a container closure of a container having a lower closure element and a closure cap placed on the lower closure element, the lower closure element being connected to an opening of a container by a base element having a contact flange which rests on an interior of the container against a contact face formed in an area of the opening of the container, the improvement comprising: said base element comprising at least one locking projection (12) disposed at a distance from the contact flange (11) in an axial direction of the container closure, said at least one locking projection (12) being embodied as one of a circumferential collar and a plurality of projections (12) disposed offset over the circumference of the base element (13) extending over a rim of the opening (43), holding said lower closure clement axially immovable in the container (40), said at least one locking projection (12) having a deflection slope (12.1) rising in a direction toward the closure cap (20) and transitioning towards the contact flange into a locking flank which rests around the rim (42) of the opening (43) on the outside of the container (40), the deflection slope (12.1) passing over in a section (13.1) extending toward the closure cap and having at its end portion directed toward the closure cap exterior dimensions which are one of the same as and less than the dimension of the opening (43).

2. In a container closure in accordance with claim 1, wherein said at least one locking projection (12) and the contact flange (11) of the base element (13) are made of a resilient plastic material, whereby the rim (42) of the opening (43) is maintained braced and without play between said at least one locking projection (12) and the contact flange (11), and the contact flange (11) sealingly rests against the contact face of the container (40).

3. In a container closure in accordance with claim 1, wherein the base element (13) comprises a chamfer (13.2) by which the base element (13) is threaded from the inside of said container (40) into the opening (43).

4. In a container closure in accordance with claim 1, wherein the exterior dimension of the closure cap (20) is smaller than the dimensions of the opening (43).

5. In a container closure in accordance claim 1, further comprising an elastic, axially extractable bellows (14) connected to the base element (13) of the lower closure element, said elastic, axially extractable bellows (14) making a transition into a pouring spout (15) having an exterior thread on which the closure cap (20) is screwed, and a sealing plate (30) with a handle (32) inserted into the pouring spout (15).

6. In a container closure in accordance with claim 1, wherein the contact face of the container (40) is folded toward the outside in relation to the inner wall (44) and forms a circular receptacle, and the contact flange (11) of the base element (13) is inserted into said circular receptacle, one of terminating, flush with the inner wall (44) of the container (40) and being recessed in respect to said inner wall (44).

7. In a container closure in accordance with claim 6, wherein said at least one locking projection (12) and the contact flange (11) of the base element (13) are made of a resilient plastic material, whereby the rim (42) of the opening (43) is maintained braced and without play between said at least one locking projection (12) and the contact flange (11), and the contact flange (11) sealingly rests against the contact face of the container (40).

8. In a container closure in accordance with claim 7, wherein the base element (13) comprises a chamfer (13.2) by which the base element (13) is threaded from the inside of said container (40) into the opening (43).

9. In a container closure in accordance with claim 8, wherein the exterior dimension of the closure cap (20) is smaller than the dimensions of the opening (43).

10. In a container closure in accordance with claim 9, further comprising an elastic, axially extractable bellows (14) connected to the base element (13) of the lower closure element, said elastic, axially extractable bellows (14) making a transition into a pouring spout (15) having an exterior thread on which the closure cap (20) is screwed, and a sealing plate (30) with a handle (32) inserted into the pouring spout (15).

* * * * *